United States Patent [19]

Hetemaa et al.

[11] Patent Number: 4,640,459

[45] Date of Patent: Feb. 3, 1987

[54] DUAL RAILS FOR ROLLER PALLETS

[75] Inventors: Kalevi Hetemaa, Helsinki; Esko Naumanen, Hyvinkää ; Frans Vainio, Helsinki, all of Finland

[73] Assignee: Elevator GmbH, Baar, Switzerland

[21] Appl. No.: 685,221

[22] Filed: Dec. 26, 1984

Related U.S. Application Data

[63] Continuation of Ser. No. 445,505, Nov. 30, 1982, abandoned.

[30] Foreign Application Priority Data

Nov. 30, 1981 [FI] Finland ..... 813832

[51] Int. Cl.[4] ..... E01B 5/02

[52] U.S. Cl. ..... 238/122; 238/148

[58] Field of Search ..... 238/10 R, 17, 122, 127–129, 238/136, 142, 148, 131; 211/162; 186/62–65

[56] References Cited

U.S. PATENT DOCUMENTS

| | | | |
|---|---|---|---|
| 591,597 | 10/1897 | Galbreath | 238/128 |
| 1,168,719 | 1/1916 | French | 238/10 R |
| 1,505,116 | 8/1924 | Wiebe | 238/128 X |
| 3,084,953 | 4/1963 | McGregor | 238/10 R X |
| 3,111,265 | 11/1963 | Huber | 238/129 X |
| 3,952,839 | 4/1976 | Brown et al. | 238/129 X |

FOREIGN PATENT DOCUMENTS

| | | | |
|---|---|---|---|
| 666926 | 11/1965 | Belgium | 211/162 |
| 39582 | 12/1936 | Netherlands | 238/128 |

*Primary Examiner*—Randolph A. Reese
*Attorney, Agent, or Firm*—Martin Smolowitz

[57] ABSTRACT

This invention concerns dual rail transportation system (1) used with roller pallets on which the wheels (2) of at least one pair of wheels are swiveling. On the margins of the running surface (5) of one rail (4) have been provided relatively low steering flanges (6) with a spacing (a) nearly the same as the breath (b) of the wheel traveling thereon. The other rail has a flat running surface sufficiently wider than the surface (5) of the one rail (4) to permit swiveling of the wheel traveling thereon. The roller pallet will hereby be steered with high accuracy on the rails.

5 Claims, 2 Drawing Figures

DUAL RAILS FOR ROLLER PALLETS

This application is a continuation, of application Ser. No. 445505, filed Nov. 30, 1982 now abandoned.

The present invention concerns dual rails for load carrying pallets provided with wheels and for which the wheels of at least one pair of the two wheel pairs are swiveling. The pallets also may be fitted with walls and roof lending support to the load. In the following description, these load pallets of various types shall be called roller pallets.

The steering of roller pallets on conveyors and tracks is at present accomplished with the aid of guide rollers located on both sides of the conveyors, so that steering is directly by the edges of the roller pallets. This type of steering is complicated and expensive.

The object of the invention is to provide a new type of dual rail transportation system on which it is possible to transport roller pallets provided with at least one swiveling pair of wheels without any additional guiding means. The dual rails of the invention are characterized in that on the margins of the running surface of one rail have been provided upwardly pointing, comparatively low guiding or steering flanges, with a spacing between them slightly greater than the breadth of the wheel running on the rail. The other rail has a wider and substantially flat running surface, which is sufficiently wide to permit swiveling the pallet wheel running thereon. With the aid of the invention, the pallet swiveling wheels will be steered by the rails without the major friction and blocking which are caused by other kinds of steering of the swiveling wheels.

A favorable embodiment of the invention is characterized in that the height of the steering margin of the one rail has a ratio to the wheel diameter running thereon of about 1:20. Experiments have shown that a flange this low is very well able to steer the swiveling wheels into the direction of travel for a roller pallet.

Another embodiment of the invention is characterized in that the spacing between the rail steering margins has a ratio to the wheel breadth running thereon about 37.36. Experiments have likewise shown that a comparatively small clearance between the wheel and the steering flanges of the rail keeps the wheels continuously correctly steered.

A third embodiment of the invention is characterized in that on the upper margins of the steering flanges have been provided wheel positioning flanges pointing outward at an angle about 45°. These positioning flanges guide the swiveled wheels entering the rails, down in between the steering flanges, and they prevent derailing the roller pallet when a wheel is in a swiveled position.

Figure 1:
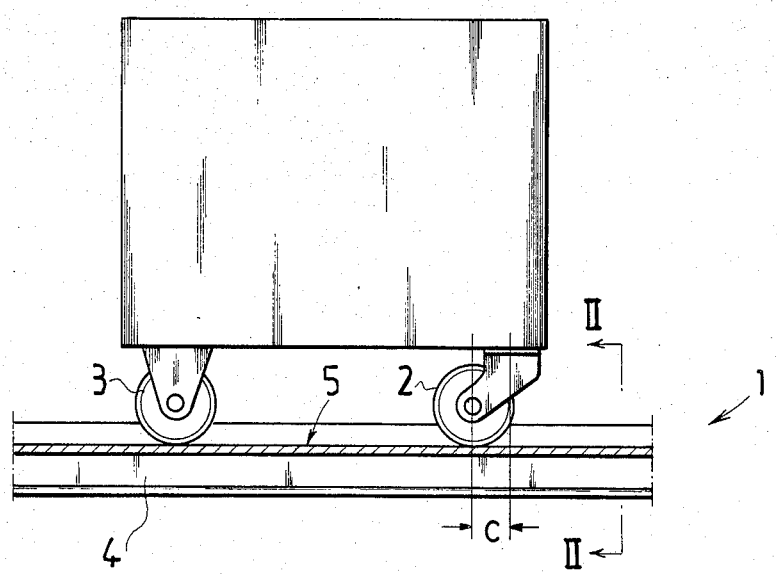

The invention is described in the following with the aid of an example, with reference to the attached drawing, wherein:

FIG. 1 presents a side elevation view of a roller pallet supported on the rails.

Figure 2:
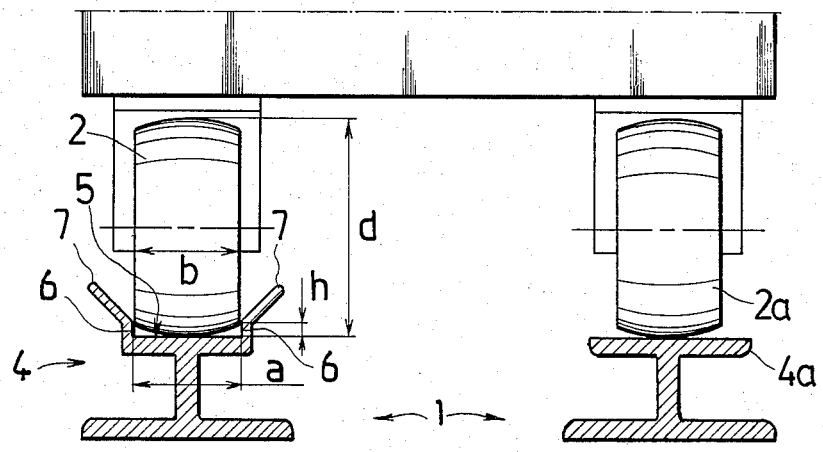

FIG. 2 shows the section of the rails and wheels taken along line II—II in FIG. 1.

As shown in FIG. 1, the wheels 2 of one wheel pair for the roller pallets on the dual rails are swiveling wheels having an offset dimension "c" shown between the horizontal axis of the wheel and the vertical axis of the wheel swivel shaft. The wheels 3 of the other wheel pair are fixed i.e., are not swiveling. On the margins of the horizontal running or traveling surface 5 of one rail 4 have been provided comparatively low steering flanges 6, their spacing a being slightly greater than the width b of the wheel. The height h of the steering flange 6 has a ratio about 1:20 to the diameter d of the wheel traveling on the running surface 5. For example, if the wheel diameter is 100 mm, the height of the steering flange 6 should be about 5 mm. The distance a of the steering flanges from each other relates to the breadth of the wheel travelling therein as a ratio about 37:36. These figures may also represent dimensions in millimeters if the wheel diameter is about 100 mm. On the top edges of the steering flanges 6 have been provided positioning flanges 7 for the wheel 2, pointing outward at an angle of about 45°. As shown in FIG. 2, the other rail 4*a* has a wider substantially flat running surface, which is sufficiently wider than running surface 5 of the one rail 4 to permit swiveling of the wheel 2*a* traveling thereon without the wheel falling off either edge of the rail.

During transport of the roller pallets on the dual rails, when a roller pallet arrives on the rails with one swiveling wheel in swiveled position, the positioning flanges will steer this wheel into the direction of travel of the roller pallet so that the wheel settles between the steering flanges 6, and thereafter very accurate steering of the roller pallet on the dual tracks will ensue.

It is obvious to a person skilled in this art that different embodiments of the invention may vary within the scope of the claims following below.

We claim:

1. Dual rails for a rail transportation system for use with roller pallets having two pairs of supporting wheels and for which at least one of the wheel pairs are swivelable and permit the roller pallets to be moved in either direction on the rails, which rails comprise:

one rail having an upper running surface and being provided on the margins of the upper running surface with dual upwardly pointing low steering flanges having spacing between the flanges slightly greater than the breadth of the wheels traveling on the rail, and on the upper margin of each steering flange is provided a wheel positioning flange pointing outward at an angle of about 45° for guiding a swiveled wheel to between the steering flanges; and one other rail horizontally spaced apart from said one rail and having a substantially flat upper running surface, said flat running surface being wider than the running surface of said one rail and having a width sufficient to permit swiveling of the wheel traveling thereon without it falling off the flat running surface of the other rail, whereby the roller pallets can travel in either direction on the dual rails.

2. Dual rails according to claim 1, wherein the height of the steering flanges has a ratio of about 1:20 to the diameter of the wheel traveling on said one rail.

3. Dual rails according to claim 1, wherein the spacing between the steering flanges has a ratio of about 37:36 to the breadth of the wheel traveling on said one rail.

4. Dual rails for a rail transportation system for use with roller pallets having two pairs of supporting wheels and for which at least one pair of the pallet supporting wheels are swivelable and permit the roller pallets to be moved in either direction on the rails, which rails comprise:

one rail having an upper running surface and being provided on the margins of the upper running surface with dual upwardly pointing low steering flanges, the height of said steering flanges having a ratio of about 1:20 to the diameter of a wheel traveling thereon, the spacing between the steering flanges being slightly greater than the breadth of the wheel traveling thereon, and having provided on the upper margin of each steering flange a wheel positioning flange pointing outward at an angle of about 45°; and one other rail horizontally spaced apart from said one rail and having a substantially flat upper running surface, said flat running surface being wider than the running surface of said one rail and having a width sufficient to permit swiveling of the wheel traveling thereon without falling off the flat running surface of the other rail, whereby the roller pallets can travel in either direction on the dual rails.

5. In combination with a roller pallet having two pairs of supporting wheels with at least one pair of the supporting wheels being swivelable and permit the roller pallets to be moved in either direction on the rails, a dual rail system comprising:

one rail having an upper running surface and being provided on the margins of the upper running surface with dual upwardly pointing low steering flanges, the height of said steering flanges having a ratio of about 1:20 to the diameter of the wheel traveling thereon, the spacing between the steering flanges being slightly greater than the breadth of said wheel traveling thereon, and having provided on the upper margin of each steering flange a wheel positioning flange which points outwardly at an angle of about 45°; and one other rail horizontally spaced apart from said one rail and having a substantially flat upper running surface, said flat running surface being wider than the running surface of said one rail and having a width sufficient to permit swiveling of the wheel traveling thereon without falling off the flat running surface of the other rail, whereby the roller pallets can travel in either direction on the dual rails.

* * * * *